United States Patent [19]

Rex

[11] 4,254,909

[45] Mar. 10, 1981

[54] RAIL CLEAT

[76] Inventor: Albert E. Rex, 38-40 Halifax St., Adelaide, South Australia, Australia

[21] Appl. No.: 942,611

[22] Filed: Sep. 15, 1978

Related U.S. Application Data

[63] Continuation of Ser. No. 801,063, May 27, 1977, abandoned, which is a continuation of Ser. No. 637,533, Dec. 4, 1975, abandoned.

[30] Foreign Application Priority Data

Dec. 6, 1974 [AU] Australia ..... 9919/74
Mar. 3, 1975 [AU] Australia ..... 0758/75

[51] Int. Cl.[3] ..... E01B 9/30
[52] U.S. Cl. ..... 238/340; 238/349
[58] Field of Search ..... 238/310, 315, 331, 338, 238/340, 349, 351, 354

[56] References Cited

U.S. PATENT DOCUMENTS

| | | | |
|---|---|---|---|
| 907,563 | 12/1908 | Braine | 238/340 X |
| 1,457,704 | 6/1923 | Kenney et al. | 238/354 |
| 1,995,020 | 3/1935 | Woodines | 238/338 |
| 1,998,043 | 4/1935 | Boyd et al. | 238/349 X |
| 2,051,982 | 8/1936 | Boyd et al. | 238/338 |
| 3,223,328 | 12/1965 | Moses et al. | 238/349 X |
| 3,436,018 | 4/1969 | Alexander | 238/349 |
| 3,451,621 | 6/1969 | De Splinter | 238/349 X |
| 3,831,842 | 8/1974 | Tamura | 238/310 X |
| 3,887,128 | 6/1975 | Ruble | 238/349 |
| 4,074,860 | 2/1978 | Rex | 238/351 |

FOREIGN PATENT DOCUMENTS

| | | | |
|---|---|---|---|
| 1300112 | 6/1962 | France | 238/349 |
| 332659 | 7/1930 | United Kingdom | 238/340 |
| 683961 | 12/1952 | United Kingdom | 238/349 |
| 1434560 | 5/1976 | United Kingdom | 238/349 |

*Primary Examiner*—Randolph A. Reese
*Attorney, Agent, or Firm*—Norbert P. Holler; Charles A. Blank

[57] ABSTRACT

This invention relates to a cleat (sometimes referred to as a "rail fastening clip") utilized for the purpose of positioning and retaining a rail to a sleeper (sometimes referred to as a "tie"). In this invention a rail cleat comprises a spring plate having a configuration such that when retained at an intermediate locality, a rail-bearing end bears against the upper surface of the foot of the rail while a tail bears against a sleeper or a bearing pad thereon, an upstanding loop standing upwardly from a sleeper, and a locking pin passing through the loop and bearing against the intermediate locality of the cleat so as to urge the cleat downwardly against the foot of the rail.

7 Claims, 8 Drawing Figures

RAIL CLEAT

This is a continuation of application Ser. No. 801,063, filed May 27, 1977, now abandoned, which is a continuation of application Ser. No. 637,533, filed Dec. 4, 1975, now abandoned.

This invention relates to a cleat (sometimes referred to as a "rail fastening clip") utilized for the purpose of positioning and retaining a rail to a sleeper (sometimes referred to as a "tie").

BACKGROUND OF THE INVENTION

Dog spikes are utilized with timber sleepers for fastening a rail thereto, but of course these are not suitable for use with concrete or steel sleepers, and the most commonly utilized device with the latter is a rod formed from high carbon steel to a configuration such that when inserted in an aperture in a shoulder projecting from a sleeper, the rod imparts a pressure against the upper surface of the rail foot holding the rail flange in position against the sleeper. When the sleeper is a steel sleeper, loops are sometimes formed in the sleeper for reception of the rod and retain the rod to the steel sleeper.

A number of difficulties however are encountered with this type of securing device. Firstly in the case of the steel sleeper the sleeper surface is weakened by the incisions made therein for receiving the rod. Secondly, the pressure between the foot of the rail and the sleeper is subject to considerable variation. Thirdly, the resilience of the rod does not give a positive location of the rail with respect to the sleeper and a slight variation in gauge becomes possible. In order to avoid this, sometimes it has been deemed necessary to utilize spacing pieces between the shoulders and the rail flange. Still further, the pressure is applied along a line contact between the rod and the foot of the rail, resulting in a very high bearing pressure which is deleterious to insulating material and makes electrical insulating difficult. If the rod is used in conjunction with a bracket welded to a steel sleeper most of the above difficulties still remain, excepting that the incisions in the sleeper are avoided.

Other fixings include clips holding down the foot of the rail and tightened by nuts which engage bolts. However the nuts loosen in some instances, and the bolt apertures weaken the sleepers. Furthermore, positioning of the bolts from beneath the sleepers is sometimes difficult. The U.S. Pat. No. 2,040,824 discloses such an arrangement.

In a slight variation of the above, bolts are used which threadably engage sleeper inserts, but these are also subject to a danger of loosening. An example of this type of structure is illustrated and described in the Australian Pat. No. 460,983 (Tetsudo Kizai Kogyo Company Limited).

Prior art also includes a number of proposals utilizing spring plates for retaining a rail to a sleeper. Thus in the U.S. Pat. No. 1,995,020 issued to Woodings there is disclosed a spring plate adapted to be driven into engagement with retention means in a lateral direction. However release of such a plate is difficult unless special equipment is used. Similar comments also apply to the U.S. Pat. No. 1,925,124 issued to Warr, wherein a tail of the plate engaged a recess in a tie plate.

The closest prior art known to the Applicants is disclosed in the now lapsed Australian Patent Application No. 25398/71 of the British Railways Board. In the specification of that patent there is disclosed a spring plate which can engage the upper surface of an insulating pad with two bearing portions, and damage to the pad due to excess bearing pressure is avoided. However assembly is still slow, or alternatively requires use of special equipment, for example to deflect the spring plate while a cross pin is inserted. The disclosure does not include means whereby the plate is easily deflected by driving a retaining pin into position, nor means whereby the tail of the plate is free to move laterally with respect to a rail (for example upon deflection of the plate). In contrast, the cleat is located by its tail. Furthermore the very considerable lateral forces imposed upon the fastening is directly resisted by a part fixed in the foundation which also retains a plate engaging pin. The absence of resilience may have a deletorious effect on such a part or the concrete surrounding it, which can be subject to considerable damage.

BRIEF SUMMARY OF THE INVENTION

The main object of this invention is to provide a cleat which will apply a restraining force against a rail foot and will retain it in firm engagement with a sleeper, and also which will locate it for gauge, but which is sufficiently resilient to avoid development of rubbing surfaces and consequential wear. Another object is to provide an assembly which is quickly and easily effected, or dis-assembled, without the need for specialized equipment.

This invention may be summarized in that a rail cleat comprises a spring plate having a configuration such that, when retained at an intermediate locality, a rail-bearing end bears against the upper surface of the foot of the rail while a tail bears against a sleeper or a bearing pad thereon, an upstanding loop standing upwardly from a sleeper, and a locking pin passing through the loop and bearing against the intermediate locality of the cleat so as to urge the cleat downwardly against the foot of the rail.

Specifically, the invention consists of a rail cleat which comprises, in combination:

(a) a plate of spring steel having a rail bearing end of shape to bear against a rail foot in a surface to surface relationship, an intermediate portion having a shoulder engaging surface, and a bearing tail;

(b) a shoulder extending upwardly from a sleeper and having walls defining an opening which extends in a direction parallel to a rail when on the sleeper; and (c) a locking pin extending through said shoulder opening and caused by walls thereof to bear downwardly against said intermediate portion applying a downward force at said rail bearing end against a rail foot (when engaging the rail foot) and also at said bearing tail against said sleeper, said shouder engaging surfaces being contiguous with the shoulder thereby locating said plate with respect to said sleeper.

In one aspect of the invention, the spring steel plate has an edge locating formation which abuts the edge of the rail flange and thereby ensures accurate location of each rail with respect to the other so that the gauge can be accurately maintained without the use of spacer pieces.

With a rail cleat which is constructed in accordance with this invention, there are several features which are advantageous over prior art. Firstly, by applying a downward deflection at an intermediate portion of the spring steel plate, a constant pressure will be caused to exist between the foot of the rail and the sleeper even when wide variations of dimension occur due to wear, manufacturing inaccuracies, or other causes.

The cleat can accurately retain the rail gauge by having a formation which abuts the edge of the rail flange over a relatively large area so that the pressure is accordingly less than, say a round section rod. This in turn results in a much simpler and more easily effected insulation of the rail from the sleeper, and the insulation is less liable to damage.

Thirdly, since the gauge is retained indirectly and through the resilient spring steel plate, the plate can absorb some of the shock when extreme lateral forces are imposed under unusual conditions, and thereby reduce damage to the shoulder, or the concrete surrounding it.

Still further, the locking pin can readily be constructed to such a configuration that it is easily driven into the opening in the shoulder and into engagement with the spring steel plate, or driven out of engagement, merely by hammer blows in a longitudinal direction with respect to the rail direction. This avoids the need for specialized equipment.

Still further, the spring steel plate thickness may itself vary so as to provide corresponding variations in loading between the cleat and the rail foot, and therefore between the rail foot and sleeper, a particularly valuable feature, since a very wide range of pressures can be easily obtained to suit the wide range of requirements of railway engineers. The available range is, in fact, so great that in many cases ancillary rail anchors are rendered unnecessary.

BRIEF DESCRIPTION OF THE DRAWINGS

The invention can take any one of a number of forms, and to illustrate these forms a number of embodiments are described hereunder in some detail with reference to and are illustrated in the accompanying drawings in which.

DETAILED DESCRIPTION OF THE EMBODIMENTS

Figure 1:
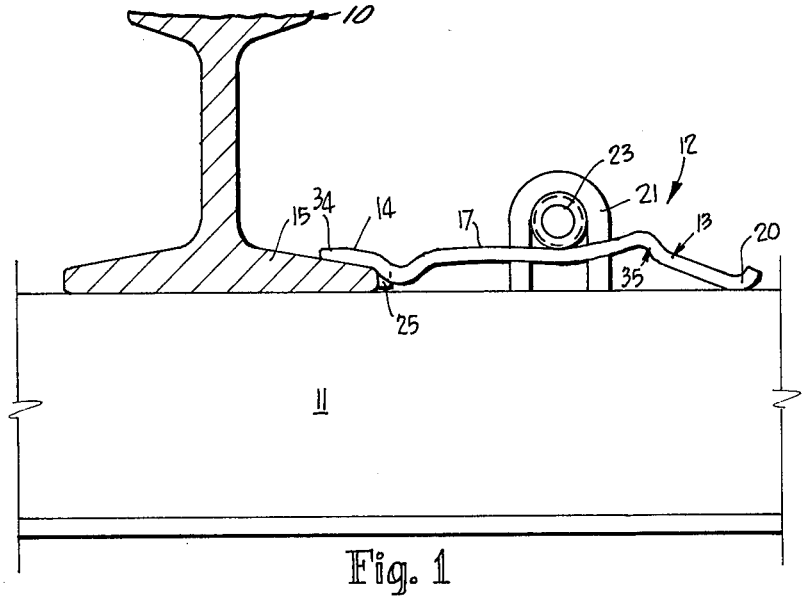
FIG. 1 is a fragmentary section through a steel rail which illustrates a first embodiment of the invention.

Referring now to the first embodiment of FIG. 1, a rail 10 is secured to a steel sleeper 11 by a pair of plates which form a cleat 12 which are constructed in accordance with this invention only one cleat 12 is shown in FIG. 1, and in the other figures it being understood that a cleat bears against the rail foot on each side of the rails.

Each cleat 12 comprises, in combination, a plate 13 of spring steel having a rail bearing end 14 which is of such shape as to bear against the rail foot 15 in a surface to surface relationship. The plate 13 has an intermediate portion designated 17 containing aperture 18 which is centrally located in a longitudinal direction but asymetrical in a lateral direction, and the walls which define the aperture 18 constitute also shoulder engaging surfaces. The steel plate 13 also has a bearing tail designated 20.

The steel sleeper 11 is provided with a shoulder 21 projecting outwardly therefrom, the shoulder 21 being of inverted U shape, being formed from rectangular section steel bar, and being joined to the sleeper 11 by welding. Being a U shape, the inner walls of the shoulder 21 define with the intermediate portion 17 of the steel plate 13 an opening which extends in the direction parallel to the rail when on the sleeper, and a locking pin 23 extends through the shoulder opening and is caused by the walls defining that opening to bear downwardly against the intermediate portion 17 of the steel plate 13, in turn applying a downward force at the rail bearing end against the rail foot 15 and also at the bearing tail against the sleeper 11, the shoulder engaging surfaces which define the aperture 18 being contiguous with the shoulder 21 thereby locating the plate 13 with respect to the sleeper.

The plate 13 is formed from a high carbon steel which has spring steel properties and is very resilient. The rail bearing end is also formed with a downturned tongue designated 25 which engages the edge of the rail foot 15 so that the location of the rail in turn is fixed with respect to the sleeper 11, thereby accurately locating rail gauge. However as seen best in FIG. 1, the elevational shape of the spring steel plate 13 is not flat, and therefore affords some resilience against lateral forces which may be imposed upon it due to the rail itself having lateral forces, but the resilience of the plate is such that the rail will always be retained with its required loading on the sleeper. Particularly it should be noted that the shoulder 21 is displaced some distance from the foot 15 so that the development of rubbing surfaces is substantially eliminated.

Figure 2:
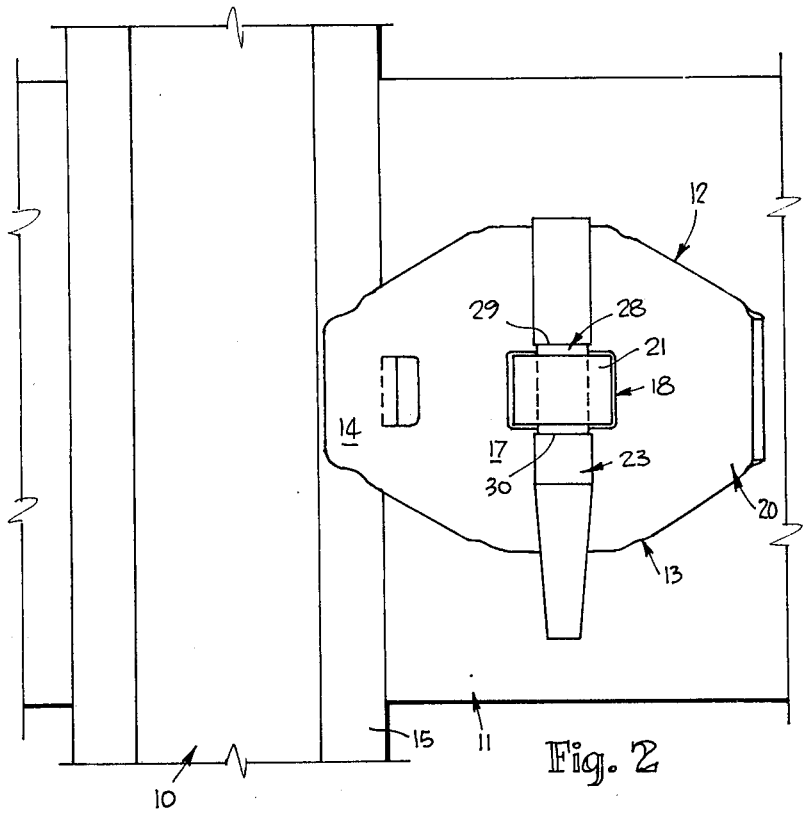
FIG. 2 is a plan of FIG. 1.

As can be seen best from FIG. 2, the locking pin 23 is provided with a tapered "lead-in" end 27 and a reduced diameter portion or "necked" portion 28 between two annular shoulders 29 and 30, the arrangement being such that the locking pin 23 may have its small diameter tapered end 27 inserted between the inner walls of the shoulder 21 and the intermediate portion 17 of the spring steel plate 13, and hammer blows delivered to the other end will drive the pin into position, and in most instances this will be sufficient to deflect the plates downwardly so that the action of driving the pin into position effects the required downward pressure on the rail bearing end 14 and the bearing tail 20. When the shoulders 29 and 30 are positioned on respective sides of the shoulder 21, the resilience of the spring steel plate 13 causes the locking pin 23 to be lifted and locked into position against displacement by engagement of the annular faces 29 and 30 against respective side surfaces of the shoulder 21. However removal is simply effected by continuing to drive the locking pin 23 with powerful hammer blows against the tapered end. A different diameter pin will cause a variation in cleat deflection and a corresponding variation in rail foot loading, this providing a simple and inexpensive means for achieving minor variations. It should be noted that the hammer blows are in a direction parallel to the rail direction, so that operation of the hammer is not interfered with by the position of the rail. However, the design is such that mechanical insertion and removal of pins is also facilitated.

Figure 3:
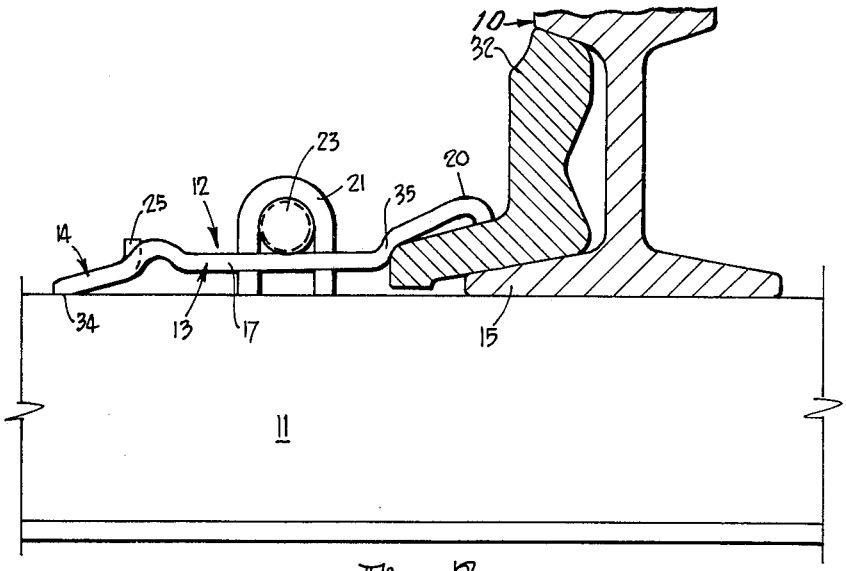
FIG. 3 is a section corresponding to FIG. 1 but illustrating the manner in which a single steel plate may be reversed so as to engage a fish plate.
Figure 4:
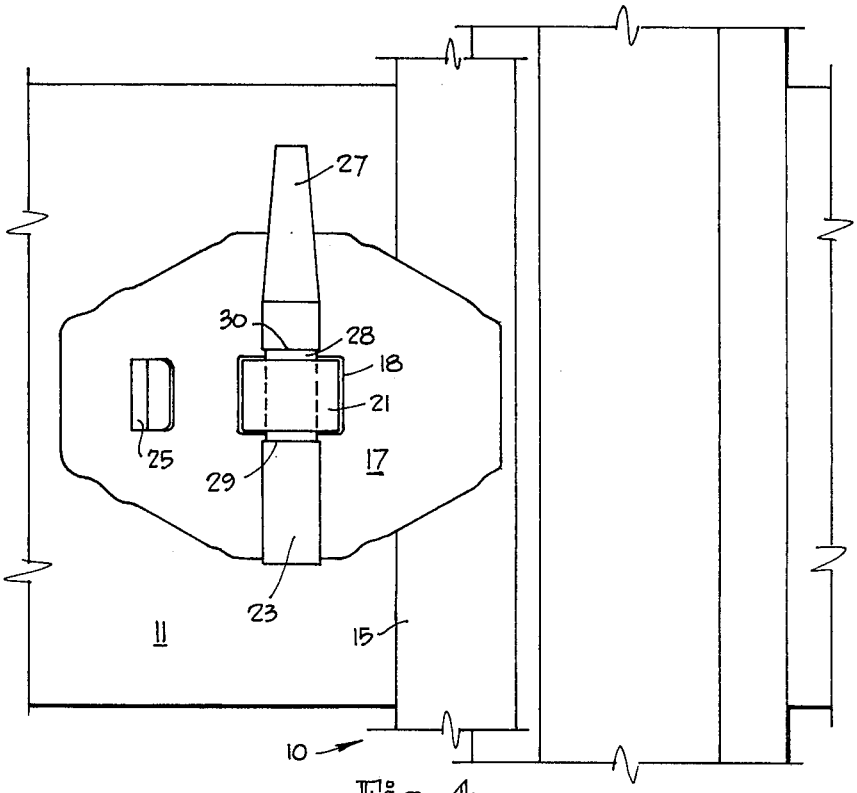
FIG. 4 is a plan of FIG. 3.

In many instances in a length of railroad track, the sleepers are positioned adjacent fish plates, and FIGS. 3 and 4 illustrate the configuration encountered in this embodiment when the fish plates are engaged by the spring steel plate 13. The plate 13 is merely inverted and rotated through 180°, whereupon the bearing tail 20 bears against the fish plate 32, while the rail bearing end 14 bears against the sleeper 11. In order to provide an area of contact which will avoid excessive bearing pressures on the rail, the rail bearing end 14 is provided with a chamfered portion designated 34.

The spring steel plate 13 is also provided with a formation designated 35 which has a vertical component of direction, as seen in best in FIG. 3, constituting a fish plate gauging formation. This formation engages an upper outer edge of the fish plate 32 and retains gauge of the rails by this means. In other respects the plate and shoulder are similar to the plate and shoulder of FIGS. 1 and 2 and the same designation numbers are shown on the drawings.

Figure 5:
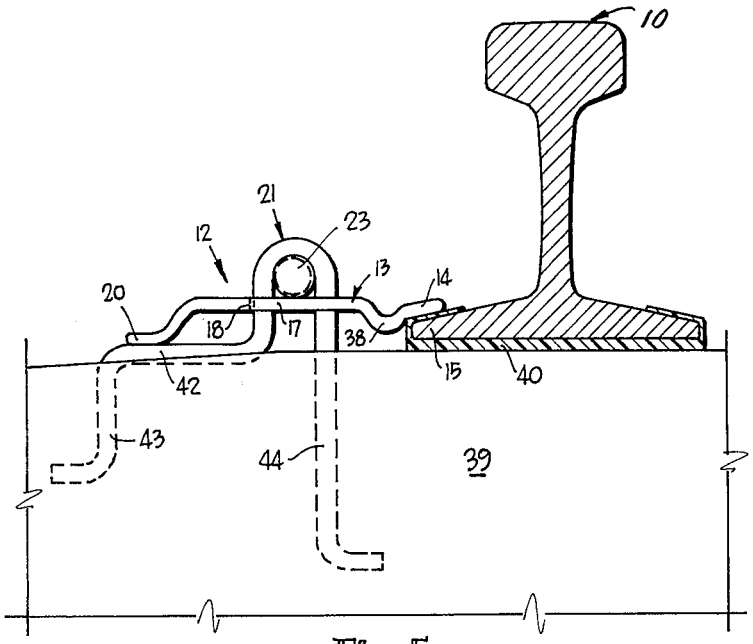
FIG. 5 is a section illustrating a second embodiment wherein a rail cleat is associated with a concrete sleeper.

In a second embodiment of FIG. 5, the same principles are included as in the first embodiment excepting that the spring steel plate 13 is not reversible for the engagement of fish plates, and instead of use being made of the tongue 25, the plate 13 has a rail gauging formation designated 38 therein, the rail gauging formation being a downwardly formed portion. Furthermore, the rail 10 is insulated from a concrete sleeper designated 39 to which it is secured by the cleat 12, by means of a pad 40 formed from resin based plastics material, rubber, neoprene or other resilient material.

In order to reduce the bearing pressure against the concrete of the sleeper 39, the shoulder 21 is provided with a horizontal bearing pad portion designated 42 which is engaged by the tail 20. The shoulder 21 has depending legs 43 and 44, each turned at its lower end, and each embedded in the concrete of the sleeper 39. The configuration of the locking pin 23 is similar to that of the first embodiment of FIGS. 1 to 4.

Figure 6:
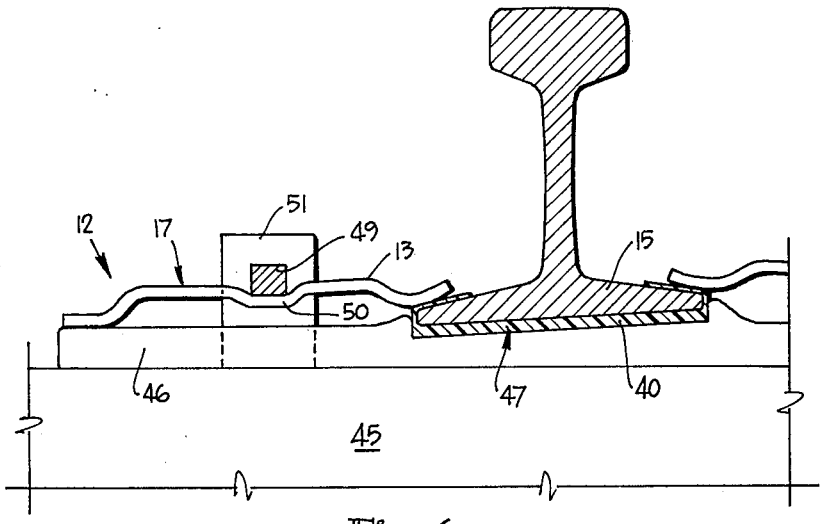
FIG. 6 is a section illustrating a third embodiment wherein a rail cleat is associated with a tie plate secured to a wooden sleeper.

In the third embodiment of FIG. 6, a timber sleeper designated 45 has secured to it a tie plate 46 by securing means (not shown) and the tie plate 46 has a recess 47 (the floor to which slopes with respect to the sleeper 45) and the rail foot 15 is again insulated by a pad 40. Instead of use being made of a circular section locking pin 23, the locking pin designated 49 in this embodiment is of square section. The spring steel plate 13 has its intermediate portion 17 formed with a depression designated 50, which engages pin 49. The shoulder is designated 51, being of different configuration from the shoulder of the other embodiments, and merely being constituted by a rectangular section bar upstanding from the tie plate 46.

Figure 7:
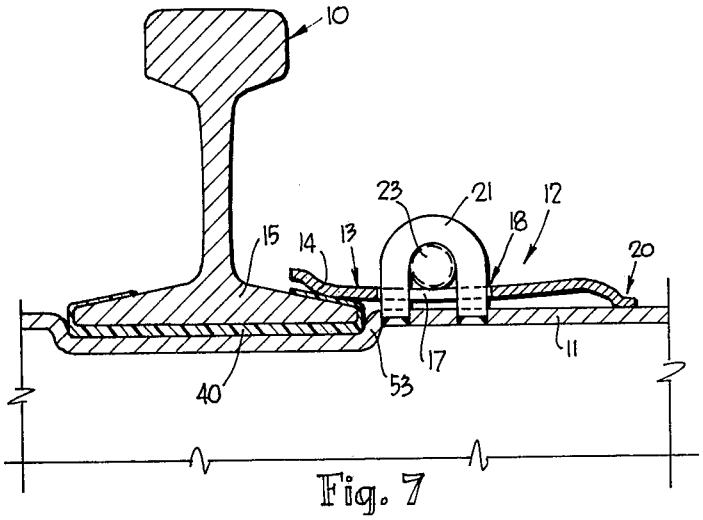
FIG. 7 is a fourth embodiment illustrating an arrangement wherein a cleat is used on a steel sleeper in conjunction with an insulating pad.

The fourth embodiment is illustrated in FIG. 7 and in many ways is similar to the second embodiment of FIG. 5. However in the fourth embodiment of FIG. 7 the rail foot 15 (again insulated by a pad 40) is located by the downwardly extending walls of a depressed formation 53 in the upper surface of the steel sleeper which is also designated 11. The intermediate portion 17 is not provided with any downward depression as in the third embodiment of FIG. 6, but the aperture 18 prevents any lateral displacement. It should be noted that the rail bearing end 14 and the bearing tail 20 are of similar shape but inverted, and the arrangement is such that the steel plate 13 may be inverted and reversed end for end and utilized, for example, on a rail of a different size. A slight distance difference between the respective ends 14 and 20 from the aperture 18 provide this simple means of using a single steel plate for different size rails. In other respects where the embodiment is similar to the first embodiment, similar elements are similarly designated.

Figure 8:
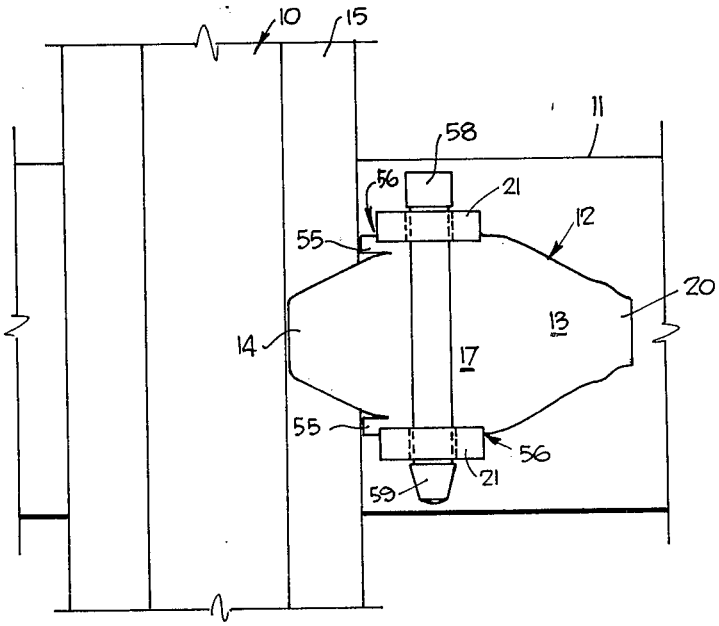
FIG. 8 is a plan of a fifth embodiment wherein a spring steel plate is retained between two shoulders by a single pin.

The fifth embodiment of FIG. 8 illustrates the flexibility of this invention. In this embodiment there are two shoulders 21 upstanding from a steel sleeper 11, and the steel plate 13 is provided with a pair of downwardly formed tongues designated 55 which engage the edge of the rail foot 15 so as to accurately locate the rail 10 with respect to the shoulders 21. The shoulder engaging surfaces of the steel plate 13 are constituted by notches designated 56 in the side edges of the steel plates 13, the notches preventing any lateral displacement of the plate 13. The locking pin 57 is provided with a head 58 at one end and a taper 59 at the other, the taper 59 however itself constituting a small head so that once the locking pin has engaged in the shoulders 21 it requires a severe hammer blow to dislodge it. It will immediately be seen that this embodiment imposes only half the loading on the shoulders 21 that is imposed with the other embodiments where a single shoulder is used. Once again, similar elements not specifically referred to in this description have the same designation numbers as in the first embodiment.

This invention enables the characteristics of a railroad track to be modified to suit the many and varied requirements of railway engineers, by the mere substitution of cleats, pins or both. The retention of pressure between rail foot and tie (sleeper), and the ability to arrange this pressure to be relatively high, makes it possible to reduce if not entirely avoid rail creep, without the need to use rail anchors.

The invention disclosed herein may be varied in structure and function by one skilled in the art without departing from the scope of the invention as defined by the claims.

I claim:

1. A resilient fastening system for fastening a rail to a sleeper, comprising:

(a) a pair of plates of spring steel each having a rail bearing end of shape to bear against a rail foot, an intermediate portion having walls defining an aperture and also forming shoulder engaging surfaces, and a bearing tail;

(b) a shoulder on each of the opposite sides of the rail foot extending upwardly from a sleeper, each shoulder having a wall defining an opening which extends in a direction parallel to a rail when on the sleeper, each shoulder being at a location a distance away from the rail foot; and (c) a respective locking pin extending through each shoulder opening and caused by the wall thereof to bear downwardly against said intermediate portion applying a downward force at said rail bearing end against the rail foot (when engaging the rail foot) and also at said bearing tail against said sleeper, each said intermediate portion being above the sleeper and being strained downwardly by said locking pin, said shoulder engaging surfaces of each plate being contiguous with a respective one of said shoulders thereby locating said plate with respect to that shoulder, each spring steel plate having a depression extending along it constituting an edge locating formation on its rail bearing end, a face of each depression being in abutting relationship with the rail foot, so arranged that, when in abutment with opposite sides of said rail foot, said faces locate the rail with respect to the shoulders such that rail gauge is maintained solely by said abutment of said rail foot by said depression faces, each plate being non-flat between its shoulder and its rail engaging end thereby providing lateral resilience.

2. A fastening system according to claim 1 wherein further edge locating formations comprise tongues extending downwardly from the plate.

3. A fastening system according to claim 1 wherein said locking pin is of circular cross-section, said pin having a reduced diameter intermediate portion terminating in a radially outwardly extending annularface on each respective end, said annular faces flanking the end walls of the said shoulder when engaged by the pin thereby restraining the pin against dislodgement in an endwise direction, the walls of portion of said locking pin tapering near one end to converge towards that end.

4. A fastening system according to claim 1 wherein said shoulder comprises an inverted U-shaped loop upstanding from said sleeper.

5. A fastening system according to claim 1 wherein said shoulder comprises a rectangular section block upstanding from the sleeper.

6. A resilient fastening system for fastening a rail to a sleeper, comprising a pair of shoulders upstanding from the sleeper at locations on opposite sides of the rail and which are spaced away from a foot of the rail, each shoulder having a wall defining an opening which extends in a direction parallel to the rail;

a pair of spring steel plates each having walls defining an aperture, the aperture walls of each plate engaging a respective one of the shoulders thereby locating the plates with respect to the sleeper, each said plate having a rail bearing end of such shape that it bears downwardly against an upper surface of the rail foot (in the absence of a fish plate over the sleeper) and also bears against a respective side edge of the rail foot thereby locating the rail with respect to the relevant shoulder while the other side end bears against the sleeper, such that rail gauge is maintained by abutment of said steel plates against said rail foot edges locating said foot edges with respect to said shoulders, each plate being non-flat between its shoulder and its rail engaging end and of such shape as to impart lateral resilience, said other end of each plate being a fish plate bearing end which is closer to the aperture walls than the rail bearing end, the fish plate bearing end being of such shape that it will bear downwardly against an upper surface of a fish plate (when over the sleeper) and also bear against a side edge of the fish plate thereby also locating the rail with respect to the relevant shoulder while said rail bearing end bears against the sleeper, the plates being repositionable over respective said shoulders to alternatively engage the rail foot or fish plate thereon, and pin means extending through respective shoulders for deflecting the plates downwardly so that they apply downward pressure at their ends.

7. A resilient fastening system for fastening a rail to a sleeper, comprising:

a pair of shoulders upstanding from the sleeper at locations on opposite sides of the rail and spaced from the foot of the rail, each said shoulder having a wall defining an opening which extends in a direction parallel to the rail;

a pair of non-flat spring steel plates each having walls defining an aperture, the aperture walls of each said plate engaging a respective one of the shoulders thereby locating the plates with respect to the sleeper, each plate having two ends unequally shaped from the aperture walls, each end of each plate being of similar shape but inverted, one end comprising a rail bearing end which bears downwardly against an upper surface of the rail foot, the other end comprising a bearing tail end which bears downwardly against an upper surface of the sleeper, each plate being repositionable over the shoulders by inverting the plates and reversing end for end to adapt the plates to a different size rail and gauge, and means engageable in said shoulder openings for deflecting the plates downwardly so that they apply downward pressure at their ends.

* * * * *